US011045022B2

(12) United States Patent
McKinney

(10) Patent No.: US 11,045,022 B2
(45) Date of Patent: Jun. 29, 2021

(54) NECK PILLOW CONVERTER

(71) Applicant: Georgene McKinney, Schaumburg, IL (US)

(72) Inventor: Georgene McKinney, Schaumburg, IL (US)

(73) Assignee: Flight Fillow, LLC, Rolling Meadows, IL (US)

( * ) Notice: Subject to any disclaimer, the term of this patent is extended or adjusted under 35 U.S.C. 154(b) by 219 days.

(21) Appl. No.: 16/236,775

(22) Filed: Dec. 31, 2018

(65) Prior Publication Data

US 2019/0374052 A1 Dec. 12, 2019

Related U.S. Application Data

(60) Provisional application No. 62/682,077, filed on Jun. 7, 2018.

(51) Int. Cl.
*A47G 9/10* (2006.01)
*A47C 7/38* (2006.01)
(Continued)

(52) U.S. Cl.
CPC ..... *A47G 9/1045* (2013.01); *A45C 3/14* (2013.01); *A45C 15/00* (2013.01); *A47C 7/383* (2013.01); *A47G 9/1081* (2013.01)

(58) Field of Classification Search
CPC ..... A47G 9/00; A47G 9/1045; A47G 9/1063; A47G 9/1081; A47C 7/383; A45C 3/14; A45C 15/00
See application file for complete search history.

(56) References Cited

U.S. PATENT DOCUMENTS 2,557,280 A * 6/1951 Hahn ..... A41D 15/04 2/66
2,727,241 A * 12/1955 Smith ..... A41D 13/081 2/66

(Continued)

FOREIGN PATENT DOCUMENTS

KR 101839899 B1 3/2018
WO WO2005009179 A2 2/2005

OTHER PUBLICATIONS

YouTube—"How To Turn a Hoodie Into a Travel Pillow" (Feb. 23, 2018). URL: https://www.youtube.com/watch?v=5UcXGC6vNwg (Year: 2018).*

*Primary Examiner* — David R Hare
(74) *Attorney, Agent, or Firm* — Marc Whipple

(57) ABSTRACT

A neck pillow converter is disclosed. A fabric tube with openings at each end also has a zippered opening in the body of the tube. A sleeved garment can be easily and efficiently rolled up to form a single long fabric item, and inserted into the zippered opening, preventing it from unrolling or becoming rumpled and disorderly as would happen if the garment were simply pulled through the tube. An optional improvement is to make the tube out of highly elastic fabric which can accommodate a variety of garment sizes, keeping smaller garments in place while allowing the use of larger garments without excessive compression. When not in use, the fabric tube is easily and efficiently folded or rolled for storage and transport. A method for using the neck pillow converter which is easy, efficient, and minimizes wrinkling and wear and tear on the sleeved garment is also disclosed.

8 Claims, 4 Drawing Sheets

(51) Int. Cl.
*A45C 15/00* (2006.01)
*A45C 3/14* (2006.01)

(56) References Cited

U.S. PATENT DOCUMENTS 4,792,073 A * 12/1988 Jacober ..... A45F 5/00 206/315.1
5,139,187 A * 8/1992 Fowler ..... A45C 9/00 224/576
5,499,401 A * 3/1996 Heinmiller ..... A41D 13/081 2/208
5,785,388 A * 7/1998 Curtis ..... A47C 7/383 297/482
D414,013 S 9/1999 Group
6,484,335 B2 * 11/2002 Gilbert ..... A47C 7/383 297/397
6,748,615 B1 * 6/2004 Tiedemann ..... B60N 2/882 5/640
6,774,296 B2 * 8/2004 Aesch ..... G10D 9/00 2/66
7,496,969 B2 * 3/2009 Pieczynski ..... A41D 13/0051 2/16
7,536,736 B1 5/2009 Martinez
8,615,814 B1 * 12/2013 Hawkins ..... A41D 13/081 2/66
8,726,421 B2 5/2014 Alvarez
10,136,685 B2 * 11/2018 Beck ..... A41D 13/081
10,426,242 B1 * 10/2019 Little ..... A45F 4/02
10,433,596 B2 * 10/2019 Baumann ..... A45C 3/06
2007/0256241 A1 11/2007 Harmon
2010/0175161 A1 * 7/2010 Jarboe ..... A45C 3/14 2/69
2010/0299800 A1 * 12/2010 Jackson, Jr. ..... A41D 13/081 2/69
2011/0017793 A1 * 1/2011 Mellion ..... A45F 3/02 224/610
2013/0152270 A1 6/2013 Neal
2015/0250240 A1 9/2015 Hunkele
2016/0135623 A1 5/2016 Montzka
2016/0297461 A1 * 10/2016 Barr-Perea ..... A45C 1/02
2017/0224033 A1 8/2017 Latta, Jr.

* cited by examiner

NECK PILLOW CONVERTER

PRIORITY CLAIM AND INCORPORATION BY REFERENCE

This application claims the priority of U.S. Provisional Patent Application No. 62/682,077 titled FLIGHT PILLOW, with an application filing date of Jun. 7, 2018. The invention as disclosed in the 62/682,077 application and as claimed herein was invented by the same inventive entity, and the entirety of the 62/682,077 application is incorporated herein by reference to provide continuity of disclosure.

This invention relates to a device for converting a sleeved garment to a neck pillow suitable for travel or other appropriate uses. A method for using the device is also disclosed.

BACKGROUND OF THE INVENTION

When traveling, a traveler may pass in and out of multiple areas which have a variety of temperature and weather conditions, including going in and out of airports and airplanes, bus stations and busses, and traveling to and from various destinations and intermediary points. At some points, it may be desirable for a traveler to have a sweater, jacket, coat, or other outer garment (for purposes of this application, all referred to as a "sweater," which includes any sleeved outer garment meant to be worn over an inner garment) which provides protection from the elements or allows the traveler to remain warm and comfortable in areas which are too cool for the traveler's preferences. At other times, the sweater may not be needed and, if removed, must be carried, adding to the number of items the traveler must carry and keep track of. A device which allows a sweater to be conveniently carried during travel when not being worn is a useful invention.

Another common need for travelers is something to increase comfort when sitting for long periods. Busses, airplanes and other common travel means require sitting in a relatively constricted position while in transit. If a person attempts to relax or sleep during transit, their head and neck may suffer discomfort as the muscles of the neck relax and allow the head to sway. Further, even while awake, the muscles of the neck and upper back may become excessively tense and uncomfortable if they must remain in tension in a specific state to support the head in the constricted range of motion allowed by most transport seating. It is common for travelers to put a sweater, if not being worn, around and behind their necks to provide support, but this requires the sweater to be folded into a position in which it may not stay, and may wrinkle or cause excessive wear and tear on the sweater. A device which allows a sweater to be easily and conveniently used as a neck pillow without causing excessive wrinkling or wear and tear on the sweater is a useful invention.

SUMMARY OF THE INVENTION

Among the many objectives of the present invention is the provision of a device for converting a sleeved garment into a neck pillow. The neck pillow comprises a central pillow body from which the sleeves of the garment depend.

Another objective of the present invention is the provision of a device which allows a sweater to be conveniently carried during travel when not being worn by streamlining it into a single linear configuration of cloth which can be looped around the neck, shoulders, or otherwise conveniently carried.

Yet another objective of the present invention is to provide a device which allows a sweater to be easily and conveniently used as a neck pillow without causing excessive wrinkling or wear and tear on the sweater.

Still another objective of the present invention is the provision of a device which can be used to convert a variety of sweaters into neck pillows easily, efficiently, and consistently.

Still another objective of the present invention is the provision of a device which converts a sleeved garment into a neck pillow and is simple, inexpensive, and compact when not in use.

These and other objectives of the invention (which other objectives become clear by consideration of the specification and drawings as a whole) are met by the preferred embodiment(s) of the invention, and the method(s) of using them, described herein.

DESCRIPTION OF THE PREFERRED EMBODIMENTS

Figure 1:
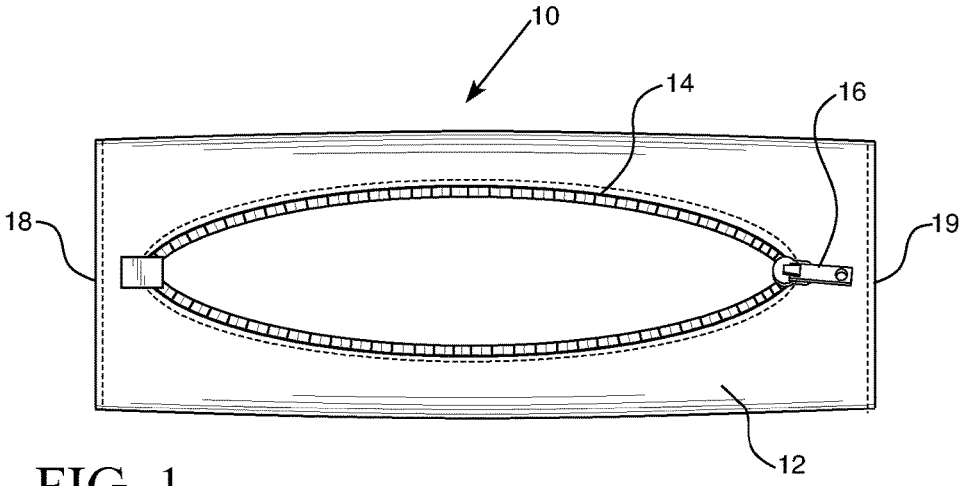
FIG. 1 is an overhead perspective view of the neck pillow converter.

Reference will now be made in detail to one or more embodiments of the invention that are illustrated in accompanying drawings. Whenever possible, the same or similar reference numerals are used in the drawings and the description to refer to the same or like parts or steps. The drawings are in simplified form and are not to precise scale. For purposes of convenience and clarity only, directional terms such as top, bottom, left, right, up, down, over, above, below, beneath, rear, and front, may be used with respect to the drawings. These and similar directional terms are not to be construed to limit the scope of the invention in any manner. The words attach, connect, couple, and similar terms with their inflectional morphemes do not necessarily denote direct or intermediate connections, but may also include connections through mediate elements or devices.

By referring to FIG. 1, the basic structure of the invention can be easily understood. Neck pillow converter 10 comprises body tube 12, a non-rigid cylindrical fabric item, defining an inner volume into which a portion of a sleeved garment can be inserted to create a neck pillow. Body tube 12 is a flexible enclosure which can be made from any reasonable and appropriate material including, but not limited to, fabric, leather, polymers, et cetera. Zipper opening 14, located in the circumferential wall/surface of body tube 12, is parallel to the axis of body tube 12. When zipper 16 is in the open position, zipper opening 14 provides a large insertion opening in the body of the neck pillow converter. When zipper 16 is in the closed position, body tube 12 has no openings along its axial length or in its circumferential wall/surface, but no matter whether zipper opening 14 is open or closed the ends of body tube 12 are open, forming first sleeve opening 18 and second sleeve opening 19.

It is preferred, but not required, that body tube 12 be formed of fabric which has sufficient elasticity to allow it to stretch to conform to a variety of rolled garments (not shown: see FIGS. 2 and 5) and hold them securely in position without losing elasticity or form after repeated usage. Preferably, the material comprising body tube 12 should be able to stretch at least 40% (forty percent) of its default dimension in any direction without unduly deforming after repeated usage. This allows the neck pillow converter to keep the garment from unrolling or becoming disorderly while not excessively compressing most garments and causing wrinkling or undue wear and tear.

Neck pillow converter 10 can be formed to any reasonable and appropriate size to conform to any particular application (smaller for use with children's garments or light sweaters, larger for use with adult sweaters or heavier garments.) matching the different needs of users.

Figure 2:
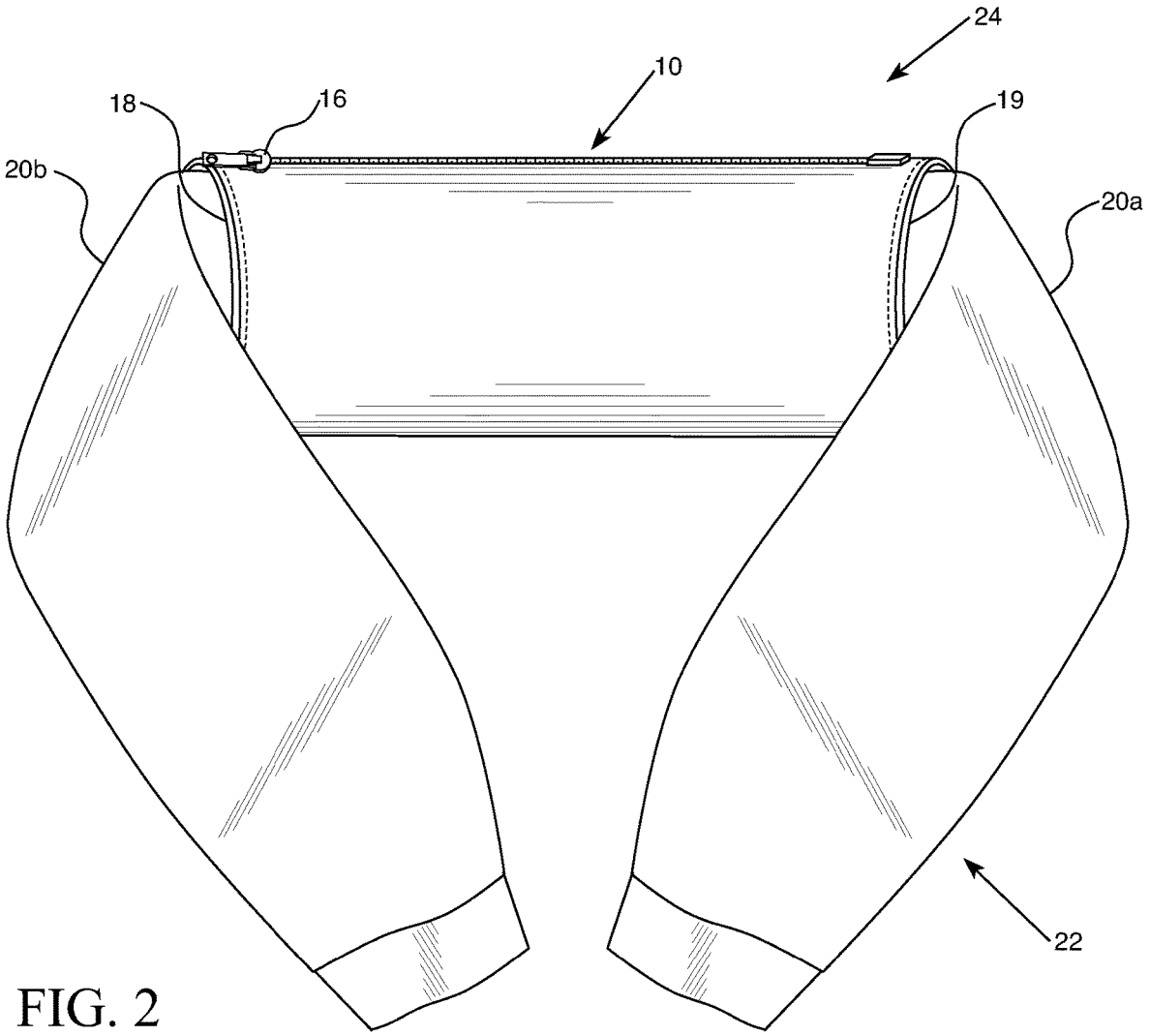
FIG. 2 is an overhead perspective view of the neck pillow converter.

FIG. 2 shows the neck pillow converter in use. Sleeved garment 22 has a body (not shown: see FIG. 5) which has been rolled up and inserted into neck pillow converter 10 through zipper opening 14 (not shown: see FIG. 1) and then zipper 16 has been moved to the closed position, holding the rolled body of sleeved garment 22 in a tight and tidy roll. Sleeves 20*a* and 20*b* emerge from first sleeve opening 18 and second sleeve opening 19 respectively. Neck pillow converter 10 and sleeved garment 22 together form neck pillow 24, which can be put behind a user's neck and used to support the head while seated. The sleeves can dangle in front of the user's chest and allow adjustment of the neck pillow, or can be put behind the back and pressed between the user's body and the seat back to help keep the pillow in position and/or provide padding, or looped around the seat to help locate and secure the pillow. The sleeves can also be tied or clipped together to form the garment into a loop which can be slung over the shoulder or around the neck or waist for easy carrying.

Figure 3:
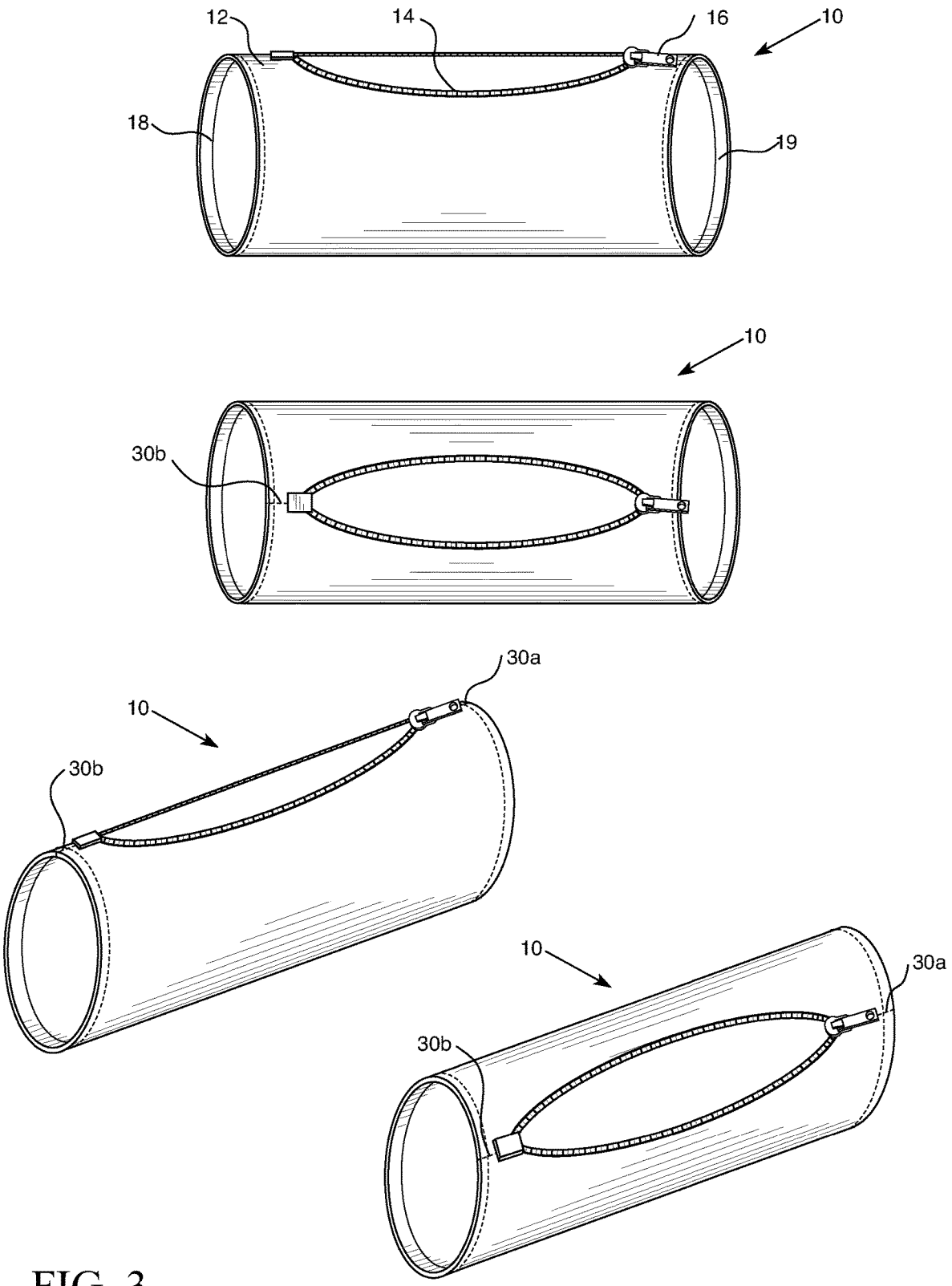
FIG. 3 is a series of illustrations of the neck pillow converter from various angles.

FIG. 3 shows neck pillow converter 10 in a variety of orientations to clarify its construction and configuration. Sleeve openings 18 and 19 are always open and form the open ends of the cylindrical body tube 12. Zipper opening 14 allows easy access to the interior of body tube 12. It is required that zipper opening 14 not communicate with the sleeve openings to maintain the shape and configuration of neck pillow converter 10 during insertion of the sleeved garment (not shown: see FIG. 2.) Zipper 16 opens and closes zipper opening 14 as will be demonstrated in the description of FIGS. 4 and 5.

Shown in the second illustration from the top and the bottommost illustration in FIG. 3 are inline seams 30*a* and 30*b*. It is preferred, but not required, to form body tube 12 by bringing together the opposing sides of a flat piece of fabric or other material, stitching zipper 16 between them, and then stitching the remaining length of the tube on either side of zipper opening 14 permanently shut with inline seams 30*a* and 30*b* which are "in line" with zipper 16. This is the most efficient means of assembling the neck pillow converter. As the invention will still function if assembled in other fashions (e.g. the seam of body tube 12, if it has one, can be anywhere around its circumference) the seam, or lack thereof, is not detailed in any other figures.

It is preferred that zipper opening 14 use a zipper to open and close, but it is not required. Any other suitable means of repeatedly sealing and unsealing an opening as shown can be used, including but not limited to buttons, snaps, ties, toggles and loops, hook-and-loop fasteners, magnetic attractors, or ridge-and-receiver style zip closings.

Figure 4:
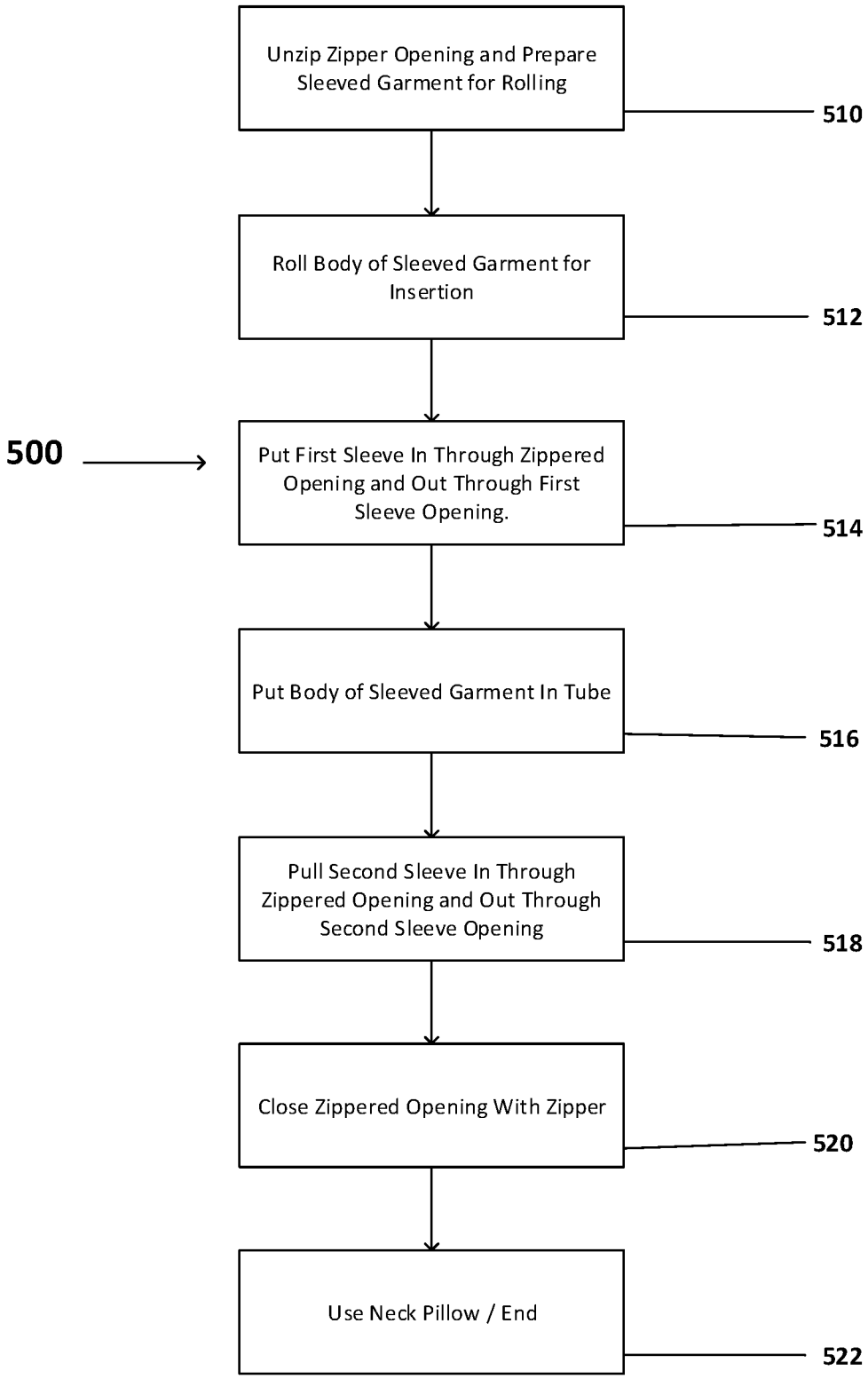
FIG. 4 is a flow chart showing the steps of the method of using the neck pillow converter.
Figure 5:
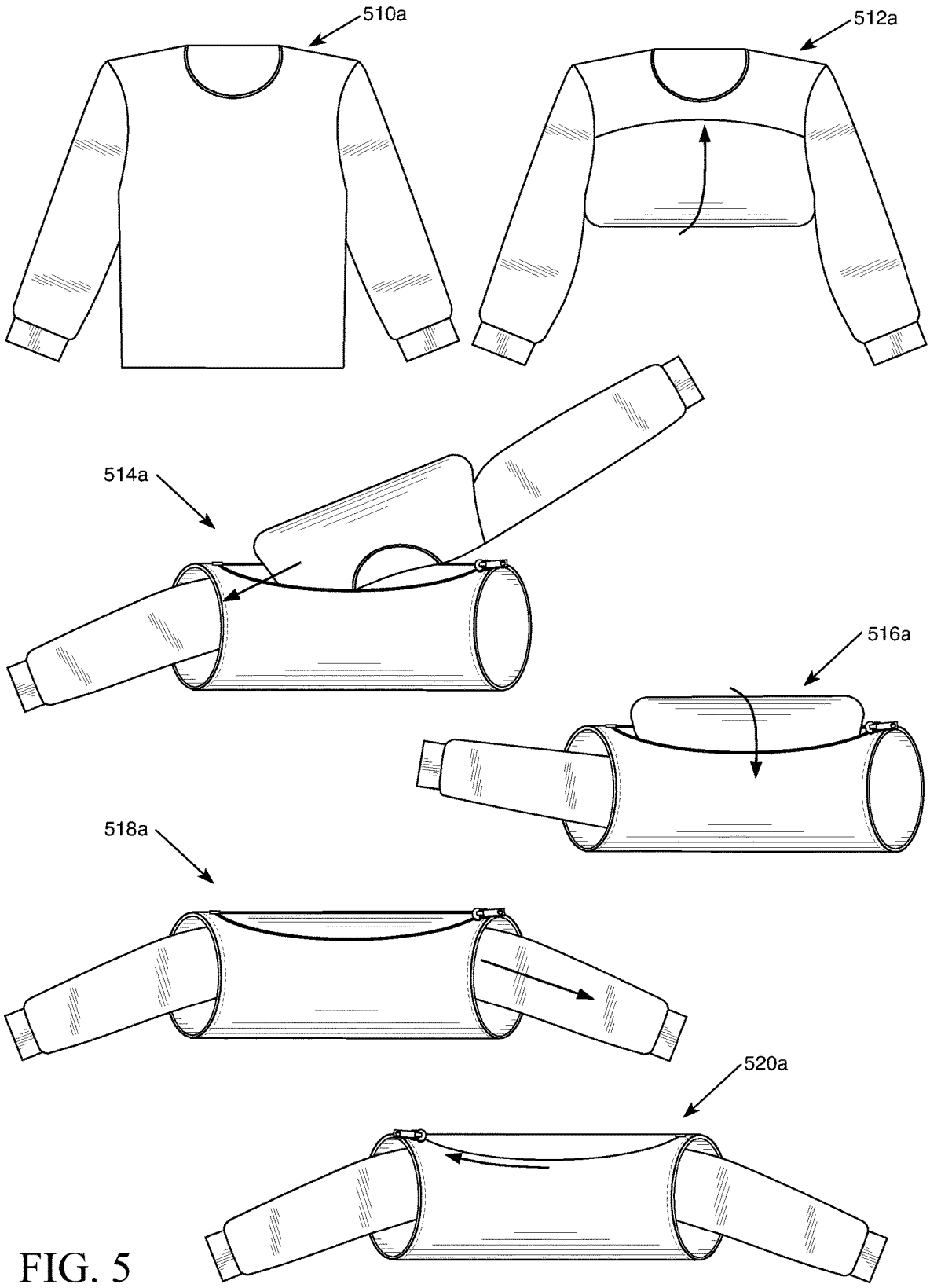
FIG. 5 is a front view illustration showing the implementation of the method of using the neck pillow converter.

FIGS. 4 and 5 illustrate the preferred method of using the invention. Method 500 comprises a series of method steps. As will be apparent, the order of the method steps is somewhat flexible: for instance, instead of putting the body of the sleeved garment into the tube and then pulling the second sleeve through (STEPS 516 and 518 respectively) the second sleeve could be pulled through and used to pull the body of the sleeved garment into the tube. So long as all the method steps are performed in a reasonable and logical order, the method will work.

In STEP 510, a user prepares to use the neck pillow converter by unzipping (opening) the zipper opening if it is not already open, and preparing the sleeved garment for rolling. Ideally, this is done by laying the sleeved garment on a flat surface (see 510*a*) but can be performed as circumstances allow, including simply rolling up the garment while holding it in the user's hands.

In STEP 512, the user rolls the body of the sleeved garment from the bottom (the end furthest from the sleeves) toward the sleeves at the top (see 512*a*.)

In STEP 514, the user inserts a first sleeve into the zipper opening and out through a first sleeve opening, until the first sleeve has substantially passed through the first sleeve opening and the part of the body of the sleeved garment adjacent to the first sleeve is proximate to the neck pillow converter. (See 514*a*.)

In STEP 516 the user inserts the body of the sleeved garment into the neck pillow converter through the zipper opening. (See 516*a*.)

In STEP 518, the user inserts a second sleeve into the zipper opening and out through a second sleeve opening, until the second sleeve has substantially passed through the second sleeve opening and the part of the body of the sleeved garment adjacent to the second sleeve is proximate to the neck pillow converter. (See 518*a*.)

It should be noted that if the body of the sleeved garment is significantly longer between the sleeves than the length of the neck pillow converter, the body may protrude through the sleeve openings. It is strongly preferred that the body of the sleeved garment be centered with relation to the neck pillow converter in this case. It is required that enough of the body of the sleeved garment be inside the neck pillow converter to keep the body of the sleeved garment rolled up in an even and orderly fashion.

In STEP 520, the zipper opening is closed with the zipper. (See 520*a*.) The neck pillow converter, filled with the body of the sleeved garment, now forms a neck pillow. (See FIG. 2.)

In STEP 522, the neck pillow is ready for use and the method ends. Not shown are optional steps wherein:

a) the sleeves are tied, clipped or otherwise fastened together to form a loop for easy carrying or suspension of the neck pillow; and/or,
b) the sleeves are looped around behind a seat and tied or otherwise fastened together to hold it in place; and/or,
c) the sleeves are draped behind the user and pressed between the user's body and a seat to form additional padding and/or hold the pillow in position; and/or,
d) the sleeves are draped in front of the user and held or otherwise secured to hold the pillow in position and/or allow it to easily be positioned and adjusted.

While various embodiments and aspects of the present invention have been described above, it should be understood that they have been presented by way of example only, and not limitation. Thus, the breadth and scope of the present invention should not be limited by any of the above exemplary embodiments.

This application—taken as a whole with the abstract, specification, and drawings being combined—provides sufficient information for a person having ordinary skill in the art to practice the invention as disclosed herein. Any measures necessary to practice this invention are well within the skill of a person having ordinary skill in this art after that person has made a careful study of this disclosure.

Because of this disclosure and solely because of this disclosure, modification of this device and method can become clear to a person having ordinary skill in this particular art. Such modifications are clearly covered by this disclosure.

What is claimed and sought to be protected by Letters Patent is:

What is claimed is:

1. A method for using a neck pillow converter comprising the steps of:

a) selecting a sleeved garment having a body section, a first sleeve, and a second sleeve, the body section having a top and a bottom, the first sleeve and the second sleeve attached to the body section at the top, the first sleeve attached to the body section diametrically opposed from the second sleeve;

b) rolling the body section from the bottom toward the top, forming a rolled section, the rolled section being located between the first sleeve and the second sleeve;

c) inserting the first sleeve into a zipper opening on the neck pillow converter;

d) pulling the first sleeve through the zipper opening into the neck pillow converter and out of the neck pillow converter through a first sleeve opening in the neck pillow converter until the rolled section is partially within the neck pillow converter;

e) pulling the second sleeve through the zipper opening into the neck pillow converter and out of the neck pillow converter through a second sleeve opening in the neck pillow converter until the rolled section is substantially within the neck pillow converter;

f) closing the zipper opening with a zipper; and, g) using the neck pillow converter, containing the rolled section, as a neck pillow.

2. The method for using a neck pillow converter of claim 1 wherein the neck pillow converter is made of an elastic material having a plurality of non-tensioned dimensions, the elastic material able to stretch from a non-tensioned state in a direction by not less than forty percent of the non-tensioned dimension corresponding to the direction and return to the non-tensioned dimension without significant loss of elasticity.

3. The method for using a neck pillow converter of claim 1 wherein the tube is not attached to the sleeved garment.

4. The method for using a neck pillow converter of claim 1 wherein the tube has no means for closing the first sleeve opening or the second sleeve opening.

5. The method for using a neck pillow converter of claim 2 wherein the tube is not attached to the sleeved garment.

6. The method for using a neck pillow converter of claim 3 wherein the tube has no means for closing the first sleeve opening or the second sleeve opening.

7. The method for using a neck pillow converter of claim 5 wherein the tube has no means for closing the first sleeve opening or the second sleeve opening.

8. The method for using a neck pillow converter of claim 3 wherein the tube has no means for closing the first sleeve opening or the second sleeve opening.

* * * * *